US005350099A

United States Patent [19]

Kienzle

[11] Patent Number: 5,350,099

[45] Date of Patent: Sep. 27, 1994

[54] DISPENSER FOR PACKAGE SEALING TAPE

[75] Inventor: Timothy Kienzle, Kansas City, Mo.

[73] Assignee: Robbie Manufacturing, Inc., Lenexa, Kans.

[21] Appl. No.: 976,958

[22] Filed: Nov. 16, 1992

[51] Int. Cl.[5] ..... B26F 3/02; B65H 16/02

[52] U.S. Cl. ..... 225/34; 225/47; 225/77; 225/84

[58] Field of Search ..... 225/34, 46, 47, 51, 225/77, 82, 84

[56] References Cited

U.S. PATENT DOCUMENTS

| | | | |
|---|---|---|---|
| 909,599 | 1/1909 | Hotchkiss | 225/77 |
| 1,173,795 | 2/1916 | Goldberger et al. | 225/77 |
| 1,967,422 | 7/1934 | Nadelson | 225/47 |
| 2,579,844 | 12/1951 | Martin | 225/47 |
| 2,826,374 | 3/1958 | Kresser | 225/34 |
| 2,961,736 | 11/1960 | Kier | 225/34 |
| 3,989,175 | 11/1976 | Cherrin | 225/77 |

*Primary Examiner*—Hien H. Phan

*Attorney, Agent, or Firm*—Kokjer, Kircher, Bowman & Johnson

[57] ABSTRACT

A device for dispensing one or more rolls of adhesive tape bearing indicia, and a method of applying such tape to a food container to maintain the container closed. The device includes a stand supporting a tube upon which rolls of indicia bearing tape are located. The tape may be drawn from the roll and laid across a platform located laterally of the tube. A first end of the platform is a biased hold down bar to maintain the tape in proper alignment. A second end of the platform includes a severing blade. The rolls of tape are oriented upon the tube such that the adhesive side of the tape is located furthest from the display platform to prevent sticking of the tape to the platform. The length of the platform is such that the indicia upon the tape is visible to the user. In use, the user will move the top and bottom trays of a food container to the closed position and secure the container using any integral fixing elements. The user will then manually grasp the free end of such tape upon the platform, pulling the tape from the roll and cutting off a portion. This portion of the tape is then secured to the container about the top and bottom trays to maintain the container in the closed position, while allowing the indicia upon the tape to be readily viewed by consumers.

3 Claims, 1 Drawing Sheet 10
12
14
16
18
30

24
28
30
30
42
24
32
46

56
54
44
50
60
46

60
40
34
44
46
20
50
52
56
54
42
38
30
24
22
26
46

60
40
36
58
38
48
26
28
30
24
32
32

DISPENSER FOR PACKAGE SEALING TAPE

BACKGROUND OF THE INVENTION

1. Field of the Invention

The present invention relates in general to packaging devices and methods. In particular, the present invention relates to an improved apparatus and method for securely sealing packages, and in particular food containers.

2. Description of the Related Art

In recent years it has become common to package food items for human consumption within inexpensive plastic containers. Such containers typically take the form of a "clamshell" container, a shallow tray and covering lid commonly employed for salads, a substantially flat cake plate with covering dome, or a jug having a wide opening and a snap-on lid. In general, the containers include a top and bottom tray (the term "tray" as used hereafter being used to describe and encompass each of those elements in the preceding sentence), one or both of which have sidewalls. The free edge or edges of the sidewalls are fixed in proximity such that the top and bottom trays together define a closed cavity. Various interengaging tongues and lips will maintain the top and bottom trays in the closed configuration. In the case of the "clamshell" type container the top and bottom trays are connected with an integral living hinge which also may be characterized as a portion of the means for retaining the trays together in the closed position.

While such containers are convenient to provide consumers with inexpensive ready to eat foods, such as salads or sandwiches, the inter engaging elements to maintain the trays in the closed position are often difficult to be placed in their fully fixed position. For example, in the "clamshell" containers a single corner portion of the inter engaging means may be placed in its proper configuration, thus holding the trays in a near-closed position, yet not be engaged in other areas. In such a situation the container often appears to be fully closed, yet will allow fluids and small solid particulates to escape from the container should it be tipped.

An even greater problem with such containers is the ease of tampering with the contents. Since the containers may be opened and reclosed without damage, it is possible that the food contained in the container has been altered or partially removed.

Additionally, it is often the case that, while the food items are ready to eat, the food stored in the container may be more appealing to the customer after further preparation. A typical example would be exposure of the food item to microwave radiation for heating. In such situations it is often desirable to provide the customer with an indication that the product may be more enjoyable upon further preparation, or to provide instructions for such preparations. To provide a reminder to the customer of such information, it has been known to affix a small label to the exterior of the container. Such label will include the information to be conveyed, such as the phrase "delicious when heated". Other information, such as promotional information or indicia for the seller may , of course, also be desired to be provided.

SUMMARY OF THE INVENTION

An object of the present invention is to provide a device to assist in securing the top and bottom trays of a container in the closed position.

Another object of the present invention is to provide a device to assist in providing instructions or indicia upon a container.

Yet another object of the present invention is to provide a device for assisting in, and a method of, securing a container in a closed position with a length of adhesive tape barring proper indicia for the respective food container.

These and other objects are achieved by a device for dispensing one or more rolls of adhesive tape bearing instructions or indicia, and a method of applying such an adhesive tape to the exterior of a food container to maintain the container in the closed position. The device includes a stand for removeably supporting a tube upon which one or more rolls of indicia or information bearing adhesive tape may be located. Resilient O-rings may be located upon the tube laterally of each roll of tape to maintain the roll in the proper position. The adhesive tape may be drawn from the roll and laid across a platform located laterally of the tube. A first end of the display platform closest to the tube includes a biased hold down bar to maintain the free length of tape in the proper alignment with the roll of such tape. A second end of the platform furthest from the tube includes a severing means in the form of a blade to allow a portion of the free length of the adhesive tape to be severed from the remainder of the tape. The rolls of adhesive tape are oriented upon the tube such that the adhesive side of the tape is located furthest from the display platform to prevent sticking of the tape to the platform. The length of the platform between the first and second ends is such that the adhesive tape, while ready to be dispensed, is displayed upon the platform and the various indicia upon the different tapes is clearly visible to the user. In use, the user will move the top and bottom trays of a container to the closed position and secure the container in such position using any integral fixing elements associated with the container. The user will then choose the appropriate indicia bearing tape mounted upon the device, and will manually grasp the free end of such tape upon the platform, pulling the tape from the roll. The user will then employ the severing means to cut off a portion of such tape. This portion of the tape is then secured to the container about the top and bottom trays to maintain the container in the closed position, while allowing the indicia upon the tape to be readily viewed by consumers. The tape will thus serve to maintain the container in the closed position, should the integral closing elements not be fully engaged, while at the same time reducing tampering and providing indicia or information.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figures 1, 2, 3, 4, 5:
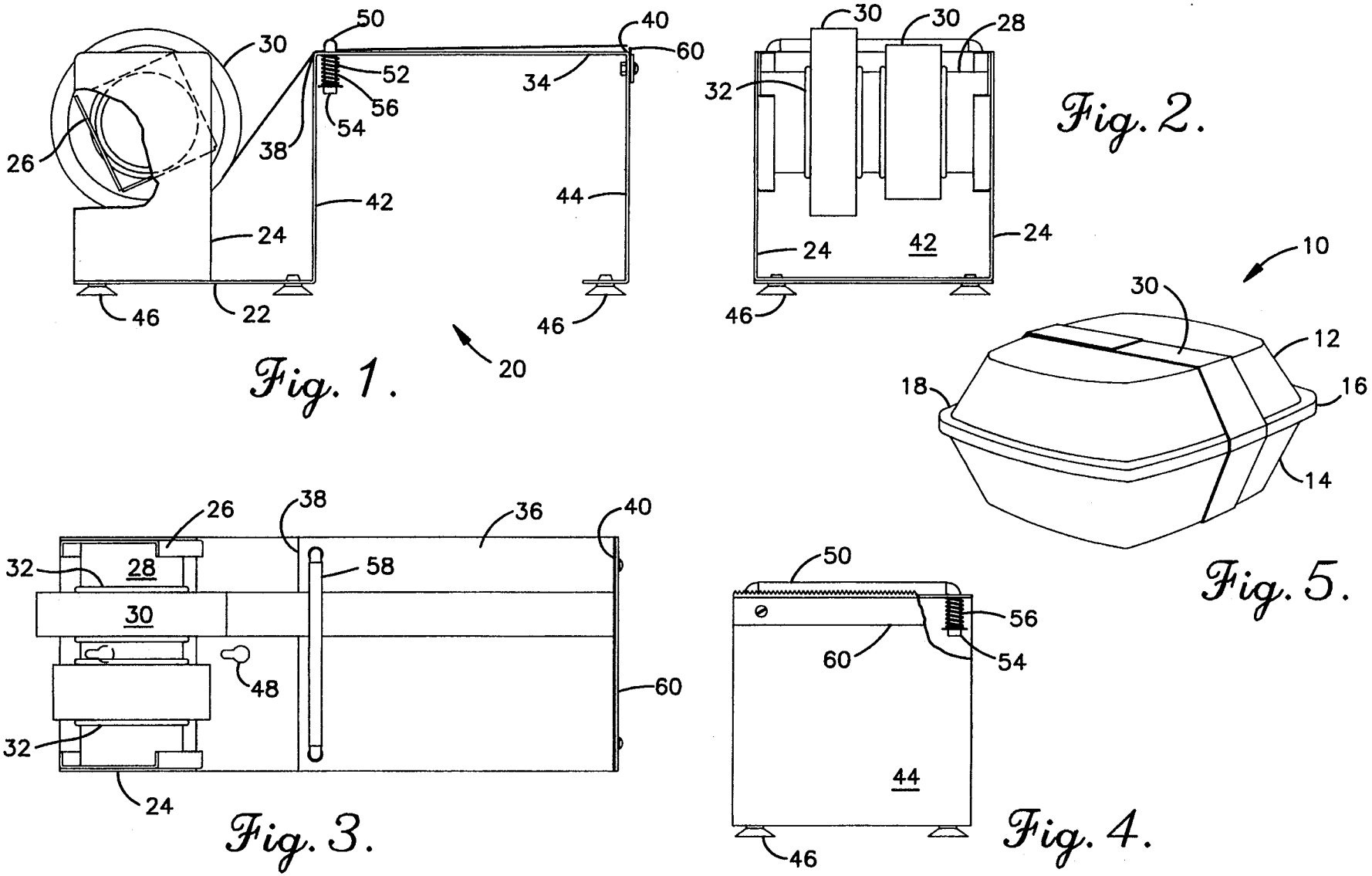
FIG. 1 is a side view of a device according to the present invention.
FIG. 2 is a rear view of the device of FIG. 1.
FIG. 3 is a plan view of the device of FIG. 1.
FIG. 4 is a front view of the device of FIG. 1.
FIG. 5 is perspective view of a food container resulting from the method according to the present invention.

Initially, with reference to FIG. 5 a prior art food container associated with the present invention is generally designated by reference numeral 10. The "clamshell" type container includes a top tray 12 and bottom tray 14, each having upstanding sidewalls to define an open cavity therein. Each of the trays also include engagement means 16 located at the free edge of the upstanding sidewalls.

Such trays are typically formed of a plastic material which has been vacuum formed, with the engagement means taking the form of tabs on one of the trays which will fit in slots in the other of the trays, interengaging lips and grooves, or other elements known in the art to maintain the top and bottom trays in a closed configuration with the free ends of the upstanding walls in close proximity to define a closed or substantially closed cavity within the interior of the container 10. As is known in the art, one of the edges of the free ends of the upstanding free wall of each of the trays 12 and 14 may be fixed together to define a living hinge 18 to maintain the top and bottom trays in association, and also serving to act as an engaging element to maintain the trays in the closed position. The container 10 will typically house a food item for human consumption, and in particular a ready to eat food item, or a ready to eat food item which may also be subjected to additional preparation.

Referring now to FIG. 1, a device according to the present invention is generally designated by reference numeral 20. The device 20 includes a roll support frame comprising a base 22 and a pair of support arms 24 extending outwardly from the base towards free ends. The support arms 24 may be substantially planar elements located in spaced parallel relationship. Located adjacent each of the free ends, or at least at a position spaced from the base 22, is a tube retainer 26 associated with each of the support arms 24. Each of the tube retainers takes the general form of at least one sidewall extending outwardly from the associated tube support 24 towards the other of the tube supports 24.

Each of these retaining walls is bent in a plane parallel to the associated support arm to define an abutment against movement in three mutually perpendicular directions within such plane, with the fourth mutually perpendicular direction within such plane being approximately perpendicular to, and outward from the base 22. In particular, the tube retainers 26 may take the form of three planar retaining walls having the general shape of a U, with the open portion of the U being furthest from the base 22. As is shown in FIG. 1, the open portion of the U need not be parallel to the base 22, but is in fact preferably located at an angle to the base for reasons made clear below.

The tube supports 26 are of a sufficient size to receive therein the longitudinal ends of a rolling tube 28 with a sliding fit. As such, the rolling tube 28 may extend between the support arms 24 and rotate with respect thereto about the longitudinal axis of the tube. The tube may be formed of a wide variety of materials, but preferably is formed of a length of plastic tubing to reduce material costs. The tube 28 has a diameter which will provide a sliding fit with the interior of one or more rolls of adhesive tape 30. The rolls of adhesive tape 30 may generally take a construction common in the art, and may include an inner cardboard cylindrical core about which is wound a length of film formed of plastic, cellophane or other well known material. A layer of tacky adhesive is located on the interior face of this tape, such that the tape is maintained in the wound condition upon the tape roll but may be easily removed therefrom as is known in the art.

It is preferred that the tape 30 include various indicia printed thereon which is intended to relate to the food item within container 10, the seller of the food item, or other information. While various arrangements are known for printing upon such adhesive tape, it is preferred that the printing be performed over the adhesive, rather than directly upon the film, to reduce the strength of the adhesive bond in the areas of printing. It has been found that such bond is particularly strong between typical adhesive tapes and typical container materials, and such a printing arrangement will ease removal of the tape from the container. The adhesive bond should not, however, be reduced to such a point that it is very readily removed, as this will reduce the tamper resistant effect of the tape.

As noted above, each of the rolls of tape 30 may be received upon the exterior of the tube 28. To maintain the tape roll in a substantially fixed longitudinal position along the tube 28 there may be employed resilient O-rings 32. The O-rings 32 may be expanded to fit over the exterior of the tube 28 and then be moved along the tube to positions adjacent each edge of the tape roll 30. The resilient nature of the O-ring will maintain it in position upon the tube 28, while the O-ring has a sufficient diameter to prevent movement of the tape roll over the associated O-ring. As such, the tape rolls may thus be movably fixed upon the tube 28 in the longitudinal direction. Where more than one tape roll is employed it is preferred that the O-rings be provided with a slight spacing from the tape rolls such that the tape rolls may rotate independently about the tube 28 for dispensing of the tape.

Fixed to the base 22 is a display platform 34 having a substantially planar upper face 36 extending in a plane parallel to the longitudinal axis of the tube 28. This plane also preferably extends substantially outward from the longitudinal axis such that the tape may be withdrawn from the roll and laid upon such upper face 36. Additionally, since the upper face 36 preferably extends substantially outward from the longitudinal axis, the upper face 36 defines a first end 38 closest to the tube 28 and a second end 40 furthest from the tube 28. Both of the ends 38 and 40 are preferably substantially parallel to the longitudinal axis.

For reasons made clear below, it is preferred that the platform 34 be located at a position spaced from the base 22 in the direction of extension of the support arms 24. As such, the device 20 may include a first platform support 42 extending between an edge of the base 22 and the first end 38 of the platform, and a second platform support 44 extending from the second end 40 of the platform in spaced apposed relation to the support 42.

The base 22 and free end of platform support 44 are adapted to rest upon a support surface to thus support the device 20. As such, it is preferred that the support 44 have a length substantially equal to that of support 42. Additionally, the device 20 may be provided with means to fix it in an operative position and against movement during unwinding of the tape. This may include a plurality of suction cups 46 located upon the bottom of base 22 and free end of support 44. Such suction cups may adhere to a generally horizontal support surface to resist movement of the device 20 as the tape 30 is manually drawn from the roll 30. Alternatively, the device may be mounted upon a substantially vertical support surface. In such an instance the base 22 may be provided with one or more key holes 48 (FIG. 3) which may receive the head of a nail, screw or other similar element to support the device 20. The key hole 48 may be employed with or without the suction cups 46. It is also noted that the angled orientation of the tube supports 26 will retain the tube in the proper position even with the device mounted vertically.

The length of upper face 36 between the ends 38 and 40 preferably has a substantial length, on the order of 15 centimeters (6 inches) for several reasons. A first of these reasons is to display the indicia upon the particular roll of tape 30. Specifically, with the tape drawn from the roll and laid across the upper face 36, the upper face 36 will support the free end of the tape and thus display it to the user. It is therefore preferred that the length of the upper face be such that at least one repetition of the indicia upon the tape roll is fully shown, so that the user may more easily choose between the different tape rolls 30 to employ the tape having the proper indicia for a particular use.

Due to this substantial length, however, typical orientation of the roll 30 such that the adhesive portion of the tape would be downward and engage with the upper face 30 would be impractical due to the excessive adhesive force of the tape along the substantial length of upper face 36. As such, it is preferred that the tape rolls 30 be oriented such that the tape drawn from the roll is oriented with the adhesive being outermost and not in contact with the upper face 36. Where this is the case, it is of course preferred that the printing be over the adhesive, or the adhesive and/or film be sufficiently transparent to allow the indicia upon the tape to be viewed.

To help maintain the free end of the tape upon the upper face 36 in a relatively constant position in the absence of such adhesive contact, there may be provided a hold down bar 50 adjacent the first end 38. The bar 50 may extend substantially parallel to the first end 38 and include a central portion adapted to abut against the upper face 36 and a pair of inwardly extending tension legs 52. The tension legs 52 may extend through appropriate holes in the platform 34 and include means for biasing the center portion into contact with the upper face 36. In particular, each of the legs 52 may include an enlarged portion 54 which may be formed as a frictionally retained cap or a nut threaded to the free end of each of the legs 52. A biasing spring 56 may then be located between the enlarged portion 54 and the platform 34 to provide the appropriate biasing force. The free end of the tape may thus be positioned upon the upper face 36 and below the bar-50, such that the bar 50 will compress the tape upon the upper face. To prevent excessive adhesive contact between the bar 50 and the tape 30, and more importantly to reduce scratching and damage to the tape indicia, the center portion of the bar may include a low friction outer coating 58, such as teflon tape.

To further help in positioning the free end of the tape upon the upper face 36, the upper face may include or be formed of a material which will generate a slight static electric charge to thus attract the free end of the tape. It is preferred that the base 22, platform 34, and supports 42 and 44 be formed of a single monolithic piece of sheet metal bent to the proper form. Where the device is employed in a food setting, this metal may preferably be stainless steel or aluminum.

The device 20 also preferably includes associated means for severing the tape 30. This means for severing may take the form of a serrated blade 60 fixed to the second end 40 of the upper face by appropriate bolts, welding or other well known means. The severing edge of the blade 60 is preferably located at a slight distance above the upper face 36 to allow the blade to be easily engaged with the tape 30. As is known in the art, the severing of the tape upon the blade 60 may result in a slight adhesion of the severed end of the tape to the blade 60, due to contact of the blade 60 with the adhesive of the tape, deformation of the plastic of the tape material upon the serrations of the blade, or other causes. Such a continued engagement of the free end of the tape 30 with the blade 60 may also aid in positioning of the tape 30 upon the upper face 36. It is also noted that the blade 60 may be quite sharp and thus pose a slight hazard to the user. As such, the substantial length of the upper face 36 provides a safety feature, as the user may engage the tape manually at a position between the ends 38 and 40, and thus spaced from the blade 60, to reduce the possibility of contact with the blade.

The operation of device 20 and method of securing containers according to the present invention will now be described.

Initially, the user will remove the tube and associated O-rings 32 from the supported position within tube supports 26. The user will remove or move the proper O-rings 32 and slide a roll of tape 30, bearing the desired indicia, upon the tube 28. The O-rings 32 will then be placed upon the tube 28 and moved to a position in closed proximity to, or snugly against, the tape rolls 30 to maintain them in a longitudinal position upon the tube 28. The user will then reinsert the tube 28 within the tube retainers 36 to thus support the tape rolls within the device. As noted above, the tape rolls are oriented such that the adhesive face of the tape will be away from the upper face 36. The user will then withdraw a length of tape from the desired ones of the rolls 30.

The bar 50 will be manually moved away from the upper face 36 against the biasing springs 56 and the free end of the tape passed beneath the bar. The bar may then be released and the free end of the tape manually drawn across the length of the upper face 36. If desired, a small segment of the free end of the tape may be engaged with and severed by the blade 60. At this point the device is ready for use and the method of securing containers in the closed position. It is noted that one or more of the above noted forces will aid in maintaining the free end of the tape in position extending across the upper face 36 such that the indicia upon the tape 30 is readily visible, albeit reversed, to the user.

The user will then obtain a container 10 intended to be maintained in the closed position. The container 10 will contain an item, typically a food item for human consumption and be in the closed position with the engagement means at least partially engaged, or the user may place the container and food item in such a condition at this time.

Depending upon the food item contained within the container 10, the user will select an appropriate one of the tape rolls 30 bearing the proper indicia to be associated with the food item. The user may then manually grasp the free end of the tape at a position between the first and second ends 38 and 40 of the upper face, preferably at a position spaced from the blade 60. The user will then lift and draw the free end of the tape upwardly from the upper face 36 and away from the tube 28, thus drawing a length of tape from the device 20. It is noted that manual contact with the upwardly facing adhesive side of the tape 30 may be employed to assist in this process. In particular, the user may manually press down upon the adhesive of the free end of the tape, and thereafter lift his or her hand away from the upper face 36, with the adhesive of the tape retaining the tape to the users hand.

The free end of the tape is then engaged with a central portion of the top or bottom tray 12 or 14 of the container 10, preferably with the bottom tray 14. It is noted that the engagement of the adhesive side of the tape with the bottom tray 14 is facilitated by the adhesive upward orientation of the tape 30, such that reorientation of the tape is not necessary. While holding the container with the attached free end of the tape in one hand, the user will draw a sufficient length of tape to fit about the container, and manually engage the tape with the blade 60 to sever the tape. The downward movement of the hand necessary to sever the tape on the blade is allowed due to the spacing of the platform and blade outward from the base 22.

Maintaining the tape in a substantially taut condition, the user will then wrap the tape about the remaining one of the trays 12 or 14, and back into engagement with the initial one of the trays. As noted above, it is preferred that the tape is initially engaged with the bottom tray, thereafter wrapped over the top tray, and then again engaged with the bottom tray. To provide the most secure seal of the tape to the container it is preferred that the tape segment employed have a length sufficient that it will contact itself upon wrapping about the container.

The final form of the container and tape segment is shown in FIG. 5. As may be readily envisioned, the segment of tape 30 will maintain the top and bottom trays 12 and 14 in the closed position even though the engagement means of the container may not be fully engaged. While the tape may be removed and the food item accessed, the process is much more difficult than without the tape, and thus tampering is reduced. Additionally, the tape segment 30 is readily visible upon the exterior of the container, such that the indicia printed upon the tape is readily visible to the consumer. The user thus ensures that the container 10 will remain in the closed position to prevent contamination of the food item, while at the same time eliminating the step of providing a separate label upon the container 10 to provide the consumer with appropriate instructions or information.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A dispenser for adhesive tape, comprising:

a base;

a pair of spaced support arms extending outwardly from said base;

a tube support mounted on each of said support arms;

a tube removably mounted to said tube supports, said tube having a longitudinal length allowing the mounting of a plurality of rolls of adhesive tape thereon;

a platform connected to said base and having an upper face adapted to receive the tape thereon which is drawn from the rolls of tape, said upper face being substantially planar and having a first end adjacent said tube and a second end spaced from said tube a distance greater than said first end is spaced from said tube;

a hold down bar mounted adjacent said first end of said upper face, said bar being resiliently biased into engagement with said upper face and adapted to have the tape drawn from the rolls of tape pass between said bar and upper face;

means for severing the tape drawn from the rolls of tape, said means being mounted adjacent said second end of said upper face;

at least one roll of adhesive tape, said roll of tape having a cylindrical core mounted coaxially about said tube and a length of flexible film having an adhesive coating on one face thereof wound about said core with said one face opposed to said core, and wherein at least one of said film and said adhesive include indicia printed thereon which is repetitive along the length of said film, said core being mounted upon said roll such that said film and adhesive, drawn from said roll of tape and laid upon said upper face without twisting about its length, has said film interposed between said adhesive and said upper face; and at least one endless elastic band mounted tube adjacent each said roll of adhesive tape, said band being in abutment with said core to thereby restrict movement of said roll of tape with respect to said tube.

2. The combination of claim 1, further comprising low friction material upon the exterior of said bar.

3. The combination of claim 1, wherein the distance between said first and second ends of said upper face is greater than the length of a single repetition of said indicia upon said adhesive tape.

* * * * *